United States Patent [19]

Stables et al.

[11] 4,392,285

[45] Jul. 12, 1983

[54] DEVICE HAVING YARN PASSAGE OF SPECIFIED DIMENSIONS FOR INTERLACING FILAMENTS OF MULTIFILAMENT YARN

[75] Inventors: Wilbur L. Stables, Matoaca; David Pendlebury, Chester; Anthony M. Saich, Colonial Heights, all of Va.; Maxwell C. Hamlyn, Cary, N.C.

[73] Assignee: Allied Corporation, Morris Township, Morris County, N.J.

[21] Appl. No.: 312,587

[22] Filed: Oct. 19, 1981

[51] Int. Cl.[3] ..... D02J 1/08

[52] U.S. Cl. ..... 28/276; 28/272; 28/274

[58] Field of Search ..... 28/271–276; 57/350, 908, 333

[56] References Cited

U.S. PATENT DOCUMENTS

| | | | |
|---|---|---|---|
| 2,985,995 | 5/1961 | Bunting, Jr. et al. | 57/350 X |
| 3,443,292 | 5/1969 | Davis, Jr. | 28/272 |
| 3,473,315 | 10/1969 | LeNoir | 28/271 X |
| 3,525,133 | 8/1970 | Psaras | 28/276 |
| 3,751,775 | 8/1973 | Psaras | 28/274 X |
| 3,828,404 | 8/1974 | Peckinpaugh et al. | 28/276 X |
| 4,223,520 | 9/1980 | Whitted et al. | 28/276 X |

*Primary Examiner*—John Petrakes

*Attorney, Agent, or Firm*—Richard A. Negin

[57] ABSTRACT

An apparatus for commingling yarn. The apparatus has an inner body having a yarn passageway with a diameter of about ¼ inch to 5/16 inch. There are orifices through which a high pressure fluid such as air pass to the yarn passageway. The orifices have a diameter of about 0.060 to 0.80 inches.

4 Claims, 6 Drawing Figures

FIG. 2
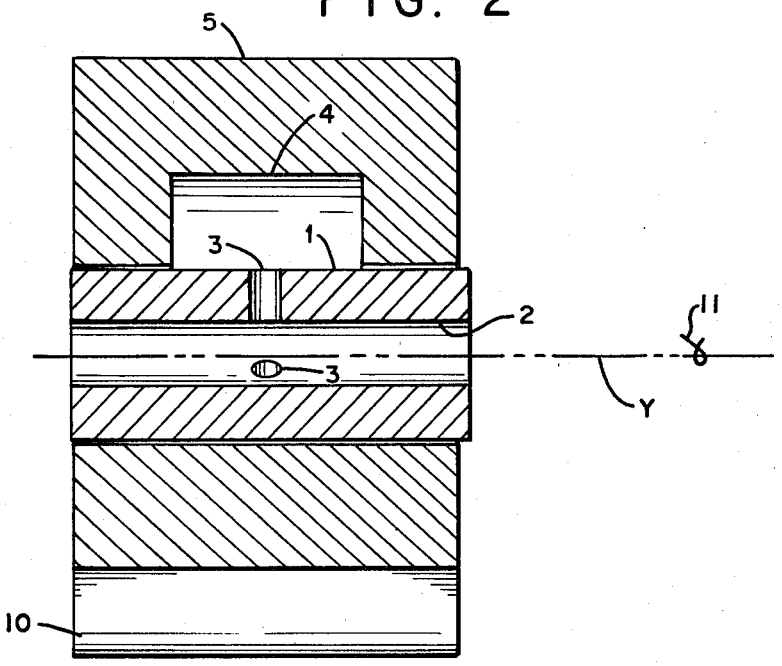
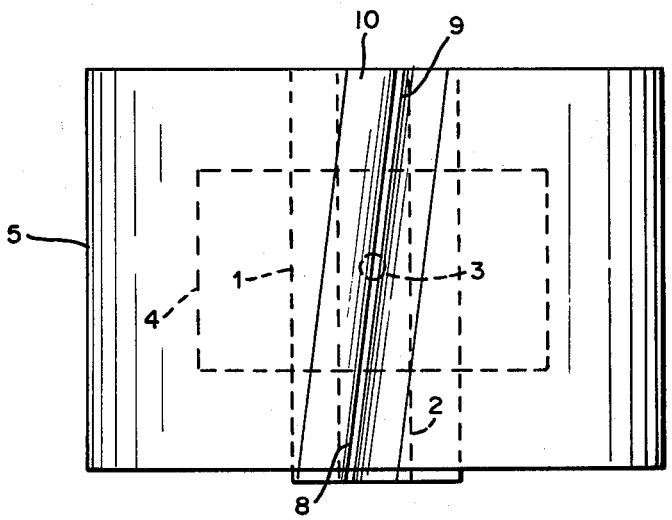
FIG. 3

DEVICE HAVING YARN PASSAGE OF SPECIFIED DIMENSIONS FOR INTERLACING FILAMENTS OF MULTIFILAMENT YARN

BACKGROUND OF THE INVENTION

This invention relates to an improved method and apparatus for commingling or entangling multifilament textile yarn by passing a continuous strand of this yarn through a yarn passageway and directing high pressure fluid from orifices onto it.

Many prior art patents show various methods and apparatus for entangling a running continuous multifilament strand of yarn. However, the prior art is directed to intersecting and tangentially-directed fluid streams or combinations of them. For example, see U.S. Pat. No. 3,443,292 to Davis and U.S. Pat. No. 3,525,133 to Psaras.

This invention is similar to the invention in U.S. Ser. No. 260,676, filed June 6, 1972, now U.S. Pat. No. 3,751,775, granted 8/14/1973. However, that invention did not require that the orifices be offset in an opposed configuration such as right-left-right or left-right-left manner, now found to be essential to good entanglement.

This invention is an improvement in the invention disclosed and claimed in U.S. Pat. No. 3,828,404. This patent relates to an improved apparatus and method for commingling multifilament yarn. The apparatus comprises an elongated body having a straight yarn passageway with at least three orifices substantially equally spaced about the periphery of the body at substantially the same level. The orifice centerlines are offset so that they do not intersect with the center of the effective diameter of the yarn passageway. These orifices are drilled with a particular eccentricity, and communicate with a source of high pressure fluid which flows through the orifices into the yarn passageway causing yarn passing linearly through the passageway to have filaments commingled with one another.

SUMMARY OF THE INVENTION

The present invention is an improved apparatus for commingling continuous multifilament yarn. The yarn preferably has a 7 to 22, more preferably 10 to 15, and most preferably 10 to 13 filament denier. The apparatus of this invention comprises an elongated body having a straight yarn passageway passing through the elongated body and at least three orifices substantially equally spaced about the periphery of the elongated body at substantially the same level. The yarn passageway has an effective diameter of about ¼ inch to 5/16 inch, and the orifices have a diameter of about 0.060 inches to about 0.080 inches. The orifices must have their extended centerline offset to one side from a radius of a circle of the effective diameter of a cross section of the yarn passageway at the orifice level. In other words, if a radius was drawn from the center point of the effective diameter these orifices would not have an extended centerline which would fall on that radius but instead would be offset. At least two of the orifices should be offset both to the same side, that is, if you were looking into the orifice from the outside toward the center of the effective diameter, they would be both offset to the left or both offset to the right. At least one of the orifice centerlines must also be offset in a direction counter to the other offset orifice centerlines. That is, if two are offset to the right, the third must be to the left. Also, none of the extended centerlines may intersect the center of the effective diameter. Another priviso is that the intersection of the extended centerlines form a polygon, such as a triangle, which must have a side nearer to the center of the effective diameter than an apex. These polygon sides must measure greater than 0.1 percent, but less than 7.5 percent of the effective diameter and the side must be at a distance greater than 0.1 percent, but less than 5 percent of the effective diameter from the center of the effective diameter.

For the purposes of the present invention, "effective diameter" is the diameter of the largest circle which fits within and yet is tangent to the opposite sides of the narrowest dimension across the yarn passageway. Thus, a circular yarn passageway has the same effective diameter as the actual passageway diameter. However, a polygonal passageway such as a rectangle would have an effective diameter equal to the narrowest dimension of the polygon. For example, a rectangular yarn passageway would have an effective diameter equal to the narrowest dimension of the rectangle.

The effective diameter range of the yarn passageway and the diameter range of the orifices of the apparatus of the present invention have been found to result in an increased amount of commingling as measured by the number of "entanglements per meter" (EPM).

The orifices communicate with a source of high pressure fluid. The high pressure fluid flows through the orifice into the yarn passageway causing swirling fluids so that any yarn passing linearly through the yarn passageway would have filaments commingled with one another. Increasing the effective diameter of the yarn passageway and the orifices results in an increase in the commingling of the filaments.

BRIEF DESCRIPTION OF THE DRAWINGS

FIG. 2 is a cross section in elevation of the commingling device.

FIG. 3 is an elevation view of the commingling device showing the string-up slot.

DESCRIPTION OF THE PREFERRED EMBODIMENTS

The present invention will be understood by those skilled in the art by reference to the figures.

Figure 1:
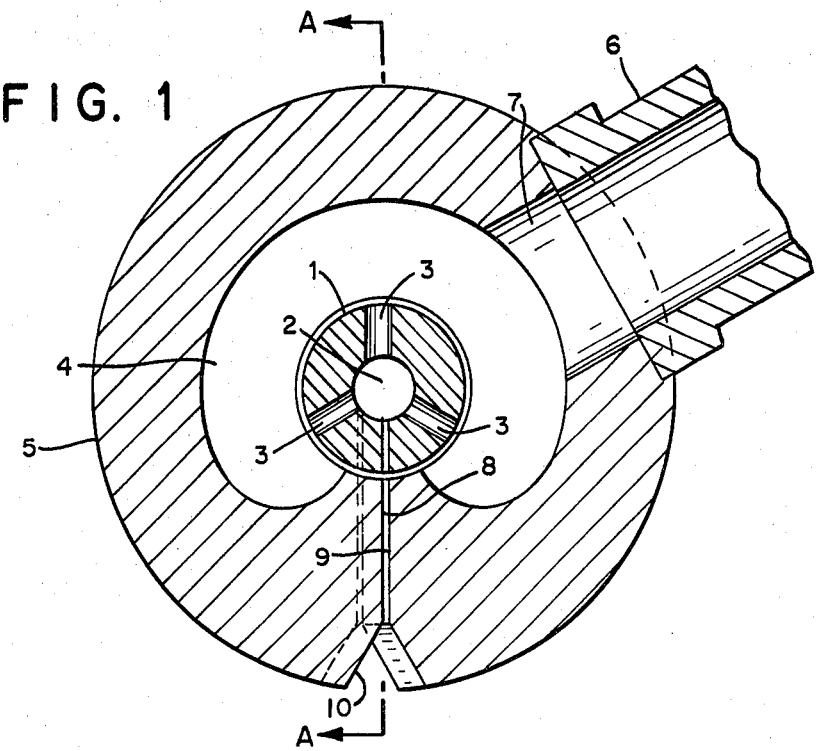
FIG. 1 is a cross section of the plan view of the commingling device at the orifice level.

FIG. 1 shows a cross-sectional plan view at the orifice level of a commingling device of this invention. Inner body 1 has yarn passageway 2 passing longitudinally through it. The yarn passageway has an effective diameter of from about ¼ inches to 5/16 inches. Inner body 1 also has offset orifices 3 spaced substantially equally about the diameter of yarn passageway 2. The orifices have a diameter of from about 0.060 inches to about 0.080 inches. These orifices are offset so that the centerline of each orifice, if extended, would not pass through the centerline of the yarn passageway 2. Orifices 3 communicate with manifold 4 which in turn communicates with large orifice 7 in register with tube fitting 6 which is secured to outer body 5. Outer body 5 can contain a string-up slot defined by the surfaces labeled 8 and 9. The string-up slot can have a flared opening 10.

FIG. 2 is an elevation view cross section at A—A on FIG. 1 of the commingling device of this invention. Like numbers indicate the same apparatus as in FIG. 1. In addition, Yarn Y is shown passing through guide 11 above yarn passageway 2. Guide 11 and another guide identical below the commingling device keep the yarn Y centered through yarn passageway 2 to effect more efficient commingling. The inner body 1 preferably has a cylindrical outer body, rather than a stepped up portion of the outer diameter as shown in U.S. Pat. No. 3,828,404. This allows the inner body 1 to take up less space. A plurality of inner bodies 1 can then be more easily in communication with a single fluid source allowing a plurality of yarns can be in close proximity to each other which is useful in sending them for further handling.

The outer diameter of the inner body 1 should fit snugly within the inner diameter of the outer body 5 so that the inner body 1 and the outer body 5 remain in their respective location during yarn commingling. Preferably, an adhesive such as an epoxy can be used to adhere the inner body 1 to the outer body 5.

FIG. 3 is an elevation view of the commingling device of this invention. Here again, like numbers indicate the same parts of the apparatus as in FIG. 1.

Figure 4:
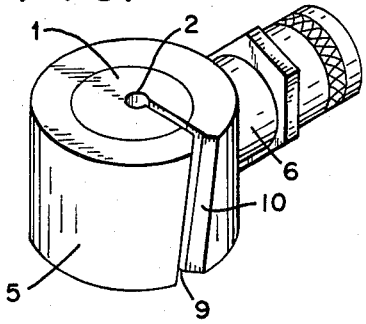
FIG. 4 is an isometric view of the commingling jet of this invention.

FIG. 4 is an external isometric view of the commingling jet. Like numbers indicate the same part of the apparatus as in FIG. 1.

Figure 5:
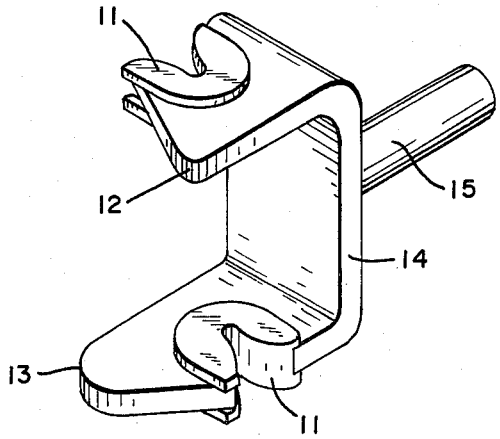
FIG. 5 is an isometric view of an optional alignment guide through which the yarn feeds to the commingling jet of this invention.

FIG. 5 is an isometric view of the double V-shaped guide which can optionally be used with this invention to align the yarn on both sides of the commingling jet. Opposing V-shaped ceramic guides 11 are mounted in lugs 12 and 13 projecting at top and bottom from body 14 of the guide. The guide is mounted to a stationary fixture with rod 15. It can be used to replace guide 11 in FIG. 2. In addition, another double V-shaped guide could be used at the exit of the device of FIGS. 1 to 4.

Figure 6:
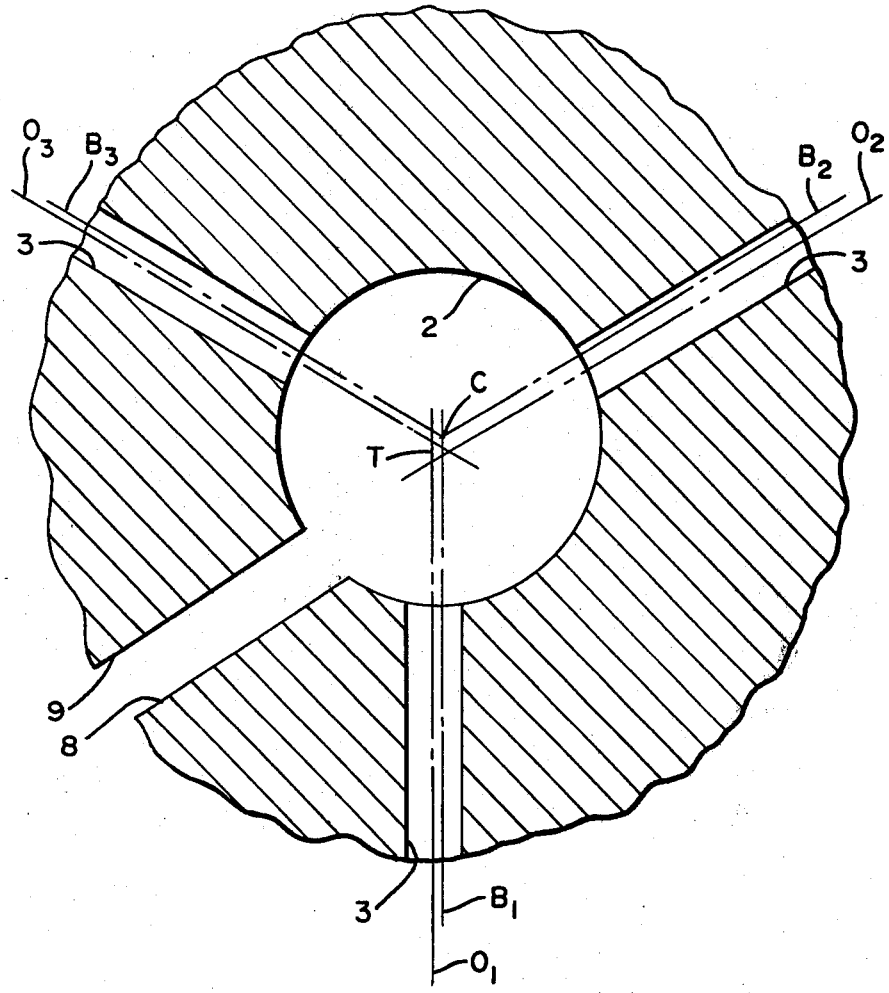
FIG. 6 is a partial cross section of the commingling device showing the circumference of the effective yarn passageway with extended orifice centerlines.

FIG. 6 is a partial cross section at the orifice level of the commingling device of this invention, showing the offset orifice centerlines and centerlines extended. Inner body 1 has yarn passageway 2 or bore extending through it in a longitudinal direction and orifices 3 in a transverse direction, as shown. Slot surfaces 8 and 9 define the string-up slot in body 1. Bore centerline or radius lines B all intersect the center or midpoint of the effective diameter C. Orifice centerlines O are all offset from bore centerlines as shown. Note that the orifice centerlines $O_1$ and $O_2$ are offset to clockwise of respective bore centerlines $B_1$ and $B_2$ when visualized as looking into the bore through the orifice from the outside of the body 1. On the contrary, orifice centerline $O_3$ is offset counter to $O_1$ and $O_2$, that is, $O_3$ is offset counterclockwise to to bore centerline $B_3$ visualized as above. These orifice centerlines O intersect near the center, to form triangle T, which does not include the center of the effective diameter C and measures at least 0.1 but less than 7.5 percent of the effective diameter across each side, and is located at a distance of greater than 0.1 percent but less than 5.0 percent of the effective diameter away from C with a side of T closer than an apex of T.

The multifilament yarn for which the apparatus of the present invention is most useful are yarns where the individual filaments preferably have a denier of 7 to 20 and more preferably a denier of 10 to 13.

The orifices communicate with a source of high pressure fluid. The high pressure fluid flows through the orifice into the yarn passageway causing swirling fluids so that any yarn passing linearly through the yarn passageway would have filaments commingled with one another.

The fluid can be any fluid which can be jetted through an orifice such as nitrogen, steam or possibly even liquids. However, the preferred fluid is air. When air is used, the fluid pressure of between 30 and 120 psig is preferred. This results in a maximum air consumption of about 30 standard cubic feet per minute for each commingling device. Compare this to about 60 SCFM consumption with the device of U.S. Pat. No. 3,473,315. Tension on the yarn passing through the commingling device can be any tension which gives the desired amount of commingling. The range is preferably from about 0.03 to about 3.5 grams per denier and more preferably from 0.07 to 0.35 grams per denier. This commingling jet provides strong tie points in the entangled yarn, that is, the points of entanglement in the yarn are much harder to pull apart than the prior art entanglements. This commingling jet provides a very good uniformity of entanglements. That is, the entanglement tie points occur at regular lengths along the length of the yarn and the strength of each individual tie point is substantially the same. Because this commingling jet has low skip area, that is, the length between tie points is not very long, it may be used in a wide range of yarn speeds up to 5,000 or even up to 10,000 feet per minute. It may be used for entangling all types of synthetic yarns. It reduces the splaying of yarn during subsequent handling operations.

The amount of commingling is indicated by the number of "entanglements per meter" (EPM). The EPM are measured by a special entanglement test based on the hook-drop test in U.S. Pat. No. 2,985,995, May 30, 1961, hereby incorporated by reference. This test has been modified to the special entanglement per meter test as follows. An entanglement among the filaments in the yarn bundle is so identified when it has the cohesion to "trigger" a needle which is allowed to slowly move through the yarn. The entanglement tester counts the number of times a needle with a 50 gram "trigger pull" in a horizontally moving yarn is "stopped." The instrument counts the "stop," raises the needle, moves a fresh portion of yarn under the needle, inserts the needle and starts the yarn moving. The instrument stops the test when the needle has moved through 2 meters of yarn. Approximately 1 meter of yarn by-passes the needle between needle insertions.

Several Examples are set forth below to illustrate the nature of the invention and the manner of carrying it out. However, the invention should not be considered as being limited to the details thereof.

EXAMPLES 1–3

The apparatus of the present invention was used to commingle multifilament polyethylene terephthalate yarn with 840 denier and 70 filaments. The individual filaments have a denier of about 12. The amount of commingling was measured based on entanglements per meter (EPM) by the method described above. Referring to the Figures the inner body 1 had three orifices. In the Examples the orifices 3 in a given inner body 1 had the same diameter. The yarn passageway 2 was circular.

The inner body 1 was one inch long with the orifices 3 centrally located ½ inch from each end. The orifices were located on a plane perpendicular to the axis of the inner body 1. The orifices were offset from centerlines $B_1$, $B_2$ and $B_3$ which were 120° apart. $O_1$ was 0.012 inches clockwise from $B_1$. $O_2$ was 0.015 inches clockwsie from $B_2$. $O_3$ was 0.012 inches counterclockwise from $B_3$. The yarn speed was 6500 feet/minute. The fluid was air at 90 psig.

The average coherency (EPM) of the yarn using a variety of inner body 1 inserts was measured. The diameters (in inches) of the yarn passage 2 (YARN PASS) and the orifices (ORIFICE) were varied. The results are summarized in Table I below.

TABLE I

| | YARN PASS DIA. (in.) | ORIFICE DIA. (in.) | EPM |
|---|---|---|---|
| Comp. 1 | 0.180 | 0.060 | 6.0 |
| Comp. 2 | 0.109 | 0.060 | 2.1 |
| Comp. 3 | 0.250 | 0.060 | 7.3 |
| Comp. 4 | 0.180 | 0.046 | 5.1 |
| Comp. 5 | 0.180 | 0.078 | 6.4 |
| Ex. 1 | 0.250 | 0.078 | 9 |
| Ex. 2 | 0.312 | 0.060 | 9.4 |
| Ex. 3 | 0.312 | 0.078 | 9.7 |

Additional runs using the apparatus of Example 3 resulted in an average EPM value of 11.8 with a range of 9.6 to 16.7.

EXAMPLE 4

The apparatus of the present invention was used to commingle multifilament polyethylene terephthalate yarn with 500 denier and 70 filaments. The individual filaments had a denier of about 7. The same apparatus as used in Example 3 was used. The yarn passage diameter was 0.312 inches and the orifice diameter was 0.078 inches. The yarn speed was 9600 feet per minute. The fluid was air at 90 psig. The EPM was measured to be 16.

We claim:

1. An improved apparatus for commingling multifilament yarn comprising an elongated body having a straight yarn passageway passing through said elongated body, said yarn passageway having an effective diameter of from about ¼ inch to 5/16 inches;

at least three orifices substantially equally spaced about the periphery of said body at substantially the same level, said orifices having a diameter of from about 0.060 inches to 0.080 inches;

at least two of said orifices having an extended centerline offset to one side from the radius of a circle of the effective diameter of a cross section of said yarn passageway at the orifice level and at least one of said orifices centerlines offset in a direction counter to the said other offset orifices, and so that none of said extended centerlines intersect the center of said effective diameter also provided that the intersection of the extended centerlines forms a polygon which must have a side nearer to the center of said effective diameter than an apex, also provided that the polygon side must measure greater than 0.1 percent but less than 7.5 percent of the effective diameter, and said side must be at a distance greater than 0.1 percent but less than 5.0 percent of the effective diameter from the center of said effective diameter;

said orifices communicating with a source of high pressure fluid so that any yarn passing linearly through said passageway would have continuous filaments commingled with one another.

2. The apparatus of claim 1 wherein said fluid is air.

3. The apparatus of claim 1 wherein said apparatus also includes a double V-shaped guide, mounted so that said yarn is constrained and aligned to enter said yarn passageway.

4. The apparatus of claim 3 wherein said apparatus also includes another double V-shaped guide mounted so that said yarn is constrained and aligned to receive said yarn as it exits said yarn passageway.

* * * * *